US011479390B1

(12) United States Patent
Salvador-Zamora et al.

(10) Patent No.: US 11,479,390 B1
(45) Date of Patent: Oct. 25, 2022

(54) LID FOR CONTAINER

(71) Applicant: Genicook Product LLC, Garland, TX (US)

(72) Inventors: Marc Salvador-Zamora, Barcelona (ES); David DeSicart-Prieto, Barcelona (ES)

( * ) Notice: Subject to any disclaimer, the term of this patent is extended or adjusted under 35 U.S.C. 154(b) by 0 days.

(21) Appl. No.: 17/518,631

(22) Filed: Nov. 4, 2021

(51) Int. Cl.
*B65D 47/06* (2006.01)
*B65D 47/08* (2006.01)

(52) U.S. Cl.
CPC ..... *B65D 47/065* (2013.01); *B65D 47/0857* (2013.01); *B65D 2547/066* (2013.01)

(58) Field of Classification Search
CPC .... B65D 43/16; B65D 43/22; B65D 2543/26; B65D 47/065; B65D 47/0857; B65D 2547/066
See application file for complete search history.

(56) References Cited

U.S. PATENT DOCUMENTS 10,214,328 B2 * 2/2019 Sorensen ..... B65D 43/22
2014/0061255 A1 * 3/2014 El-Saden ..... B65D 47/066 222/537
2018/0192800 A1 * 7/2018 Coon ..... B65D 25/46
2019/0183269 A1 * 6/2019 Kalisz ..... B65D 47/065
2022/0033148 A1 * 2/2022 Filiau ..... B65D 47/305

* cited by examiner

*Primary Examiner* — Vishal Pancholi
*Assistant Examiner* — Robert K Nichols, II
(74) *Attorney, Agent, or Firm* — Johnfar Kerlee

(57) ABSTRACT

Disclosed are embodiments of containers having lids configured for dispensing contents from the container. In one embodiment, a lid can include a spout coupled to a spout collar; the lid can further include a link coupling the spout collar to a spout cover. The spout collar and link are configured to rotate the spout cover in a direction opposite a rotation of the spout as the spout initially rotates from a stowed position to an in-use position; as the spout continues to rotate toward the in-use position the spout cover reverses rotation and rotates toward the spout to cover an inners space of the lid previously occupied by the spout. When the spout achieves the in-use position the spout cover covers the space occupied by the spout when the spout is in the stowed position. As the spout is rotated from the in-use position toward the stowed position, the spout collar and the link cause the spout cover to open and rotate away from the spout. A further rotation of the spout towards the stowed position causes the spout cover to rotate back towards the spout. When the spout achieves the stowed the position the spout completes its rotation and covers the spout.

20 Claims, 10 Drawing Sheets

LID FOR CONTAINER

FIELD

Embodiments of the invention relate generally to portable, dispensing containers and lids for such containers. In particular, embodiments of the invention are directed to liquid dispensing containers having lids with spouts and spout covers.

BACKGROUND

Portable containers, such as tumblers, mugs, and the like, are commonly used to, for example, dispense liquids when walking, driving, or otherwise traveling. Portable containers typically include a container body and a lid that is removably coupled to the container body and includes a dispensing aperture.

Some portable containers include spouts. Spouts are generally movable, relative to the container body, between a stowed position and an in-use position. When the spout is in the in-use position, the contents of the container can be dispensed through the spout. When dispensing is no longer desired, the spout can be moved to the stowed configuration, whereby the contents are prevented from flowing out of the container.

There is a need in the relevant technology for lids, for such containers, having a spout cover that can cover and protect, from dirt (for example), an inner space of the lid when the spout is in the in-use position. Embodiments of the invention disclosed here satisfy this need.

SUMMARY OF THE INVENTION

In one aspect, the invention is directed to a method of manufacturing a lid for a container. The method involves providing a spout; providing a spout collar and coupling the spout collar to the spout; providing a link and coupling the link to the spout collar; providing a spout cover and coupling the spout cover to the link; configuring the spout collar and the link to: (i) rotate the spout cover away from the spout as the spout initially rotates from an inner space of the lid in a stowed position of the spout towards an in-use position of the spout; (ii) rotate the spout cover back towards the spout as the spout continues a rotation toward the in-use position; (iii) close the spout cover over said inner space as the spout reaches the in-use position; (iv) rotate the spout cover away from the spout as the spout initially rotates from the in-use position toward the stowed position; (v) rotate the spout cover back towards the spout as the spout continues a rotation toward the stowed position; and (vi) close the spout cover over the spout as the spout reaches the stowed position.

The method can further include providing an actuator and coupling the actuator to the spout collar. In one embodiment, the method further includes providing a collar pivot and coupling the collar pivot to the spout collar, the collar pivot configured to provide a rotation support for the spout collar; providing a spout cover pivot coupling the spout cover pivot to the spout cover, the spout cover pivot configured to provide a rotation support for the spout cover; and coupling the link, respectively, to the spout collar and to the spout cover at locations other than the collar pivot and the spout cover pivot.

In certain embodiments, providing a link can include providing a first link arm; providing a second link arm; and providing a crosspiece and coupling the crosspiece to the first link arm to the second link arm. In some embodiments, providing a first link arm can involve providing a cover extension; providing a collar extension; coupling the spout cover to the collar extension; and coupling the collar extension to the spout collar. In one embodiment, providing a collar extension can include providing an extension distal end, wherein the extension distal end bends at an angle relative to a longitudinal axis of the collar extension.

In another aspect, the invention concerns a lid for a container. The lid can include a spout collar; a spout coupled to the spout collar; a link coupled to the spout collar; and a spout cover coupled to the link. From a stowed position of the spout, an initial rotation of the spout collar in a first direction causes, via the link, the spout cover to rotate in a second direction, said first direction being towards an in-use position of the spout, said second direction being counter to the first direction; wherein a further rotation of the spout collar in the first direction causes, via the link, the spout cover to rotate in a third direction, said third direction being rotationally in the same direction as the first direction; wherein from the in-use position of the spout, an initial rotation of the spout collar in a fourth direction causes, via the link, the spout cover to rotate in a fifth direction, said fourth direction being towards an stowed position of the spout, said fifth direction being rotationally in the same direction as the fourth direction; wherein a further rotation of the spout collar in the fourth direction causes, via the link, the spout cover to rotate in a sixth direction, said sixth direction being counter to the fifth direction; wherein, in the in-use position of the spout, the spout cover is in a closed position and covers a space that is occupied by the spout when the spout is in the stowed position; and wherein, in the stowed position of the spout, the spout cover is in a closed position covering the spout.

The lid can further include an actuator coupled to the spout collar. The lid can further include (i) a collar pivot operatively coupled to the spout collar, the collar pivot configured to provide a rotation support for the spout collar; (ii) a spout cover pivot operatively coupled to the spout cover, the spout cover pivot configured to provide a rotation support for the spout cover; (iii) and wherein the link attaches, respectively, to the spout collar and to the spout cover at locations other than the collar pivot and the spout cover pivot.

In one embodiment, the link can include a first link arm; a second link arm; and a crosspiece coupling the first link arm to the second link arm. At least one of the first link arm and the second link arm can include: a cover extension; a collar extension; wherein the cover extension is coupled to the spout cover and to the collar extension; and wherein the collar extension is coupled to the spout collar. In some embodiments, the collar extension can include an extension distal end, and wherein the extension distal end bends at an angle relative to a longitudinal axis of the collar extension.

Yet another aspect of the invention is concerned with another embodiment of a lid for a container. The lid can include a spout; a spout cover; and a link operatively coupling the spout and the spout cover so that (i) as the spout begins to emerge from an inner space of the lid, the movement of the spout causes, via the link, the spout cover to begin a rotation towards on open position; (ii) further rotation of the spout towards an in-use position causes, via the link, the spout cover to rotate away from the spout and towards a fully open position of the spout cover; (iii) additional rotation of the spout to the in-use position causes, via the link, the spout cover to revert back to a closed position, and thereby, cover an inner space of the lid previously occupied by the spout; (iv) as the spout begins to rotate toward a stowed position from the in-use position, the movement of the spout causes, via the link, the spout cover to open and rotate away from the spout; and (v) as the spout is rotated into the stowed position the spout cover rotates back towards the spout to cover the spout.

The lid can include a spout collar coupled to the spout and to the link, wherein the spout is operatively coupled to the spout cover through the spout collar and the link. In one embodiment, the spout and the spout collar are one integral piece. In certain embodiments, the lid includes an actuator coupled to the spout collar. In some embodiments, the link includes a first link arm; a second link arm; and a crosspiece coupling the first link arm to the second link arm. In one embodiment, at least one of the first link arm and the second link arm includes a cover extension; a collar extension; wherein the cover extension is coupled to the spout cover and to the collar extension; and wherein the collar extension is coupled to the spout collar. In certain embodiments, the collar extension includes an extension distal end, wherein the extension distal end bends at an angle relative to a longitudinal axis of the collar extension.

In some embodiments, the lid includes a collar pivot operatively coupled to the spout collar, the collar pivot configured to provide a rotation support for the spout collar; and a spout cover pivot operatively coupled to the spout cover, the spout cover pivot configured to provide a rotation support for the spout cover.

Additional features and advantages of the embodiments disclosed herein will be set forth in the detailed description that follows, and in part will be clear to those skilled in the art from that description or recognized by practicing the embodiments described herein, including the detailed description which follows, the claims, as well as the appended drawings.

Both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein.

DETAILED DESCRIPTION

Figure 1:
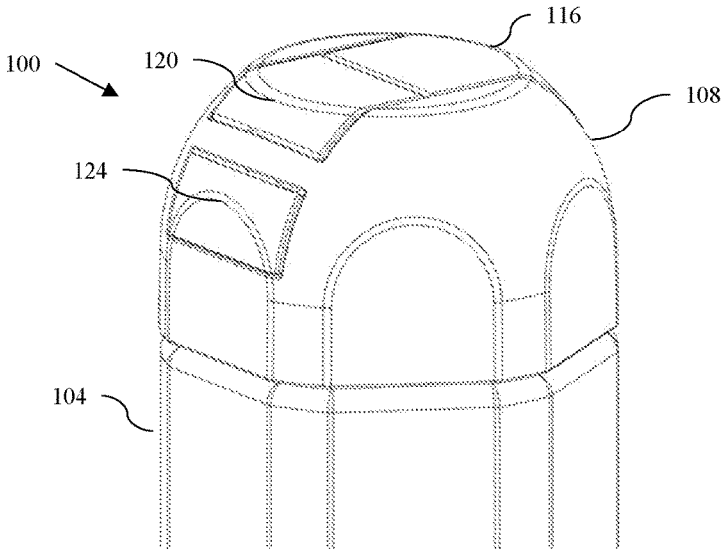
FIG. 1 is a partial, perspective view of a container having a lid in accordance with one embodiment of the invention. The container is illustrated having a spout in a stowed position.

The specific details of the single embodiment or variety of embodiments described herein are set forth in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Figure 2:
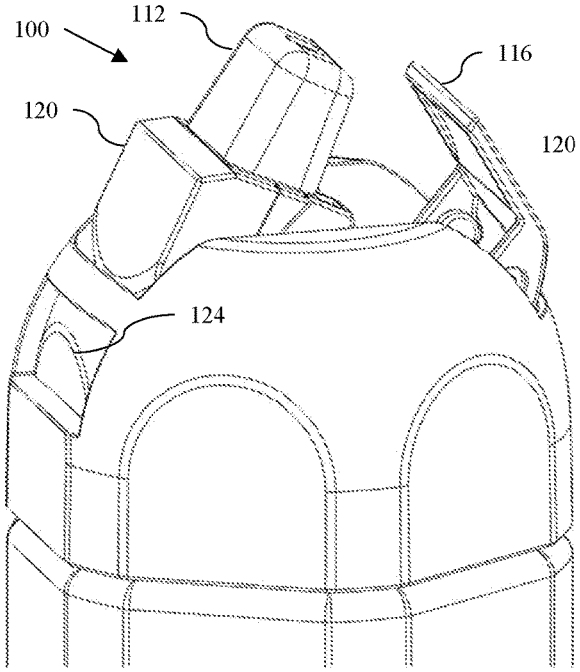
FIG. 2 is another perspective view of the container of FIG. 1 having the spout in an intermediate position between an in-use position and the stowed position.
Figure 3:
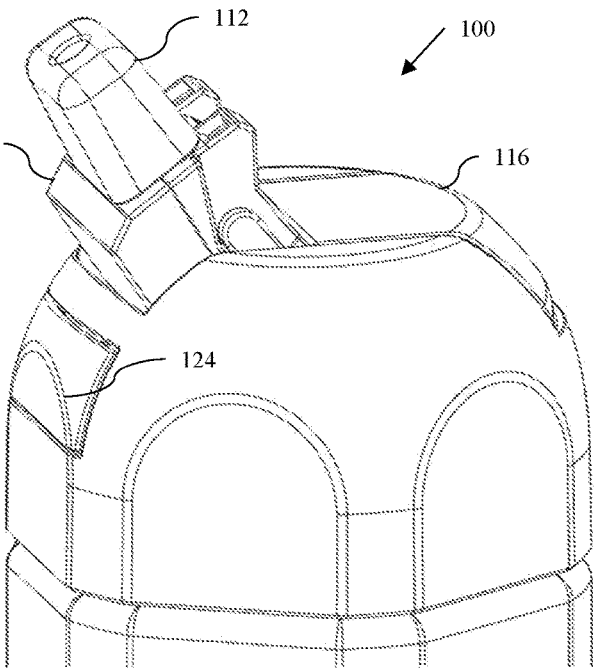
FIG. 3 is another perspective view of the container of FIG. 1 having the spout in an in-use position.

Referencing FIG. 1 through FIG. 3, one embodiment of the invention is directed to container 100 having containing body 104 and lid 108. Containing body 104 can be, for example, a bottle, a cup, a mug, a tumbler, or the like. Lid 108 can be removable from containing body 104. In one embodiment, lid 108 can be coupled to containing body 104 via a threaded engagement. In other embodiments, lid 108 can be coupled to containing body 104 via a snap fit or other suitable engagements.

FIG. 1 shows container 100 in a stowed configuration wherein spout 112 is covered by spout cover 116. Spout collar 120 engages a lower portion of spout 112 and forms part of lid 108 to maintain spout 112 covered and inside an internal space of lid 108. In one embodiment, actuator 124 can be provided to actuate a release of spout 112 via, for example, a disengagement of actuator 124 and spout collar 120. As shown in FIG. 2, a translation of actuator 124 inwardly causes spout 112 to emerge from an internal space of lid 108, and spout cover 116 rotates away from spout 112. As shown in FIG. 3, in an in-use position, spout 112 is in a position for dispensing contents from container 100, and spout cover 116 has rotated toward spout 112 to a closed position. Thus, both during the in-use position and in the stowed position spout cover 116 is in a closed position. In one embodiment, spout cover 116 is opened only while spout 112 is emerging from lid 108 to move to an in-use position or while spout 112 is returning into lid 108 to move to the stowed position. This configuration is advantageous in preventing dirt (for example) from entering the inside of lid 108 while spout 112 is an in-use position.

Figure 4:
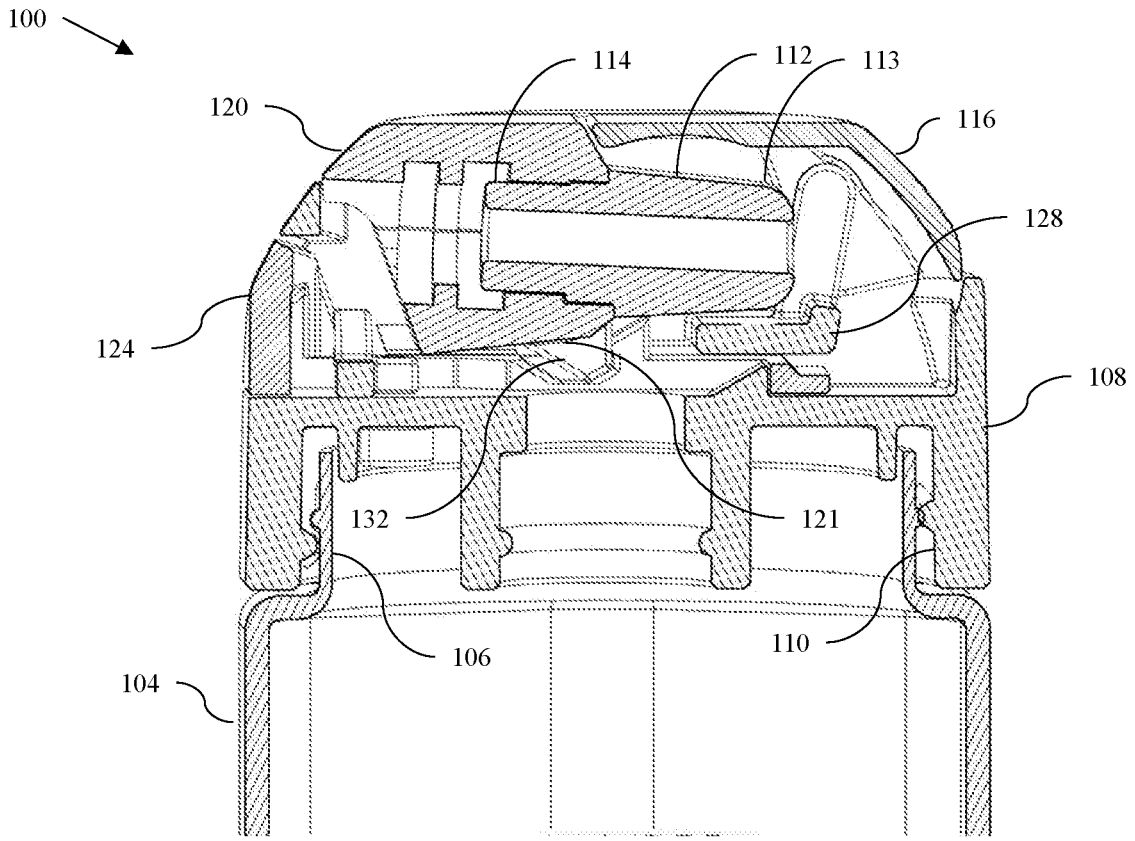
FIG. 4 is a cross-sectional view of the container of FIG. 1 with the spout in a stowed position.
Figure 5:
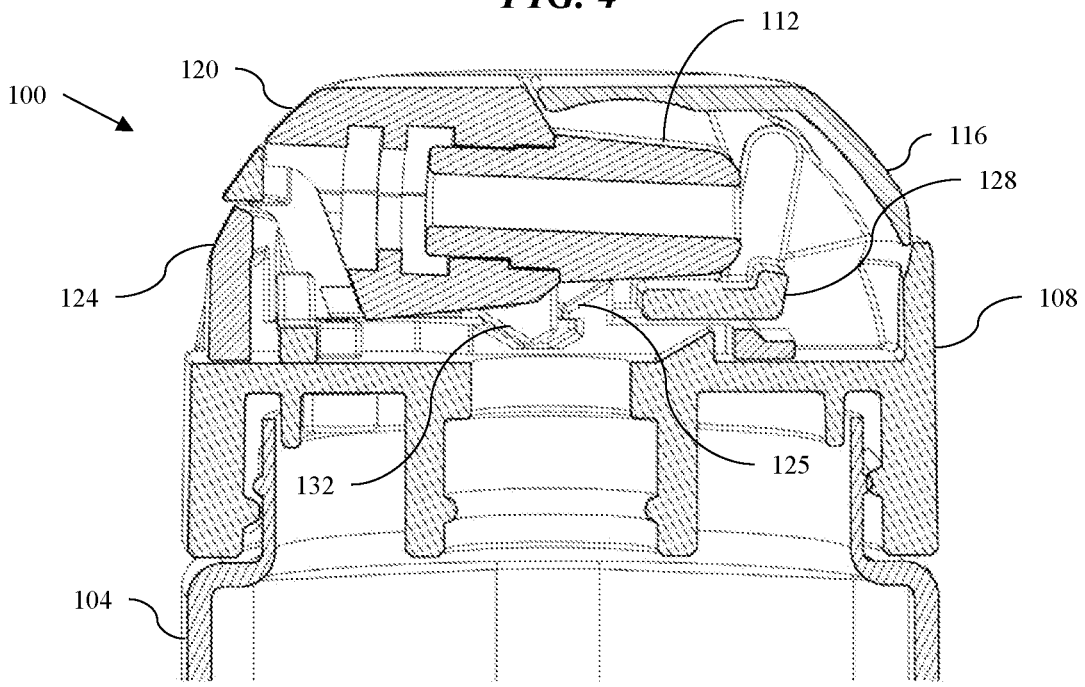
FIG. 5 is another cross-sectional view of the container of FIG. 1 illustrating a disengagement of an actuator from a spout collar.

Referencing FIG. 4, in one embodiment container 100 can include containing body 104 having containing body threads 106 for engaging corresponding lid threads 110. In one embodiment, spout 112 can include spout upper portion 113 and spout lower portion 114. In some embodiments, spout lower portion 114 is configured to engage collar upper portion 121. In certain embodiments, link 128 is configured to operatively couple spout collar 120 with spout cover 116. As will be discussed in greater detail below, spout 112, spout cover 116, and link 128 are operatively configured to cause spout cover 116 to open away from spout 112 as spout 112 emerges from lid 108 (see FIG. 2), and to rotate back towards spout 112 as spout 112 is positioned in the in-use position (see FIG. 3). FIG. 5 shows actuator 124 moved partially inward toward the center axis of container 100, which causes actuator hook 125 to begin to disengage collar catch 132. In some embodiments, a biasing element (not shown) can be provided to bias actuator 124 towards the outer edge of lid 108. These biasing elements and configurations are well known in the relevant technology. For example, a spring (not shown) can be coupled between actuator 124 and a fixed part of lid 108.

Figure 6:
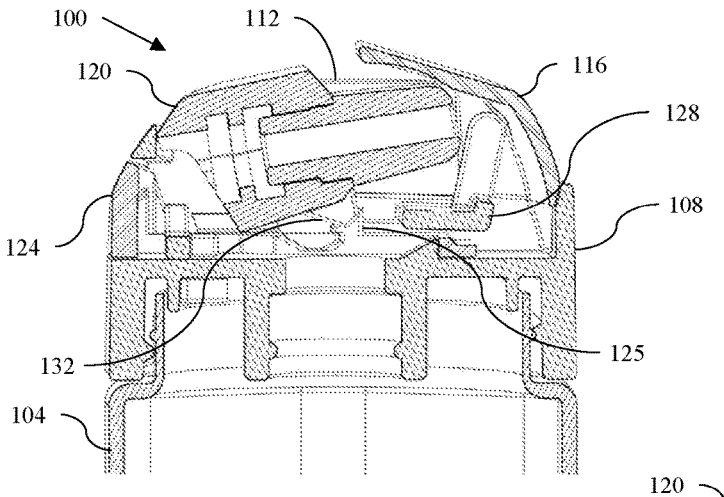
FIG. 6 is another cross-sectional view of the container of FIG. 1 illustrating an initial movement of a spout collar from the stowed position of the spout toward an in-use position of the spout.
Figure 7:
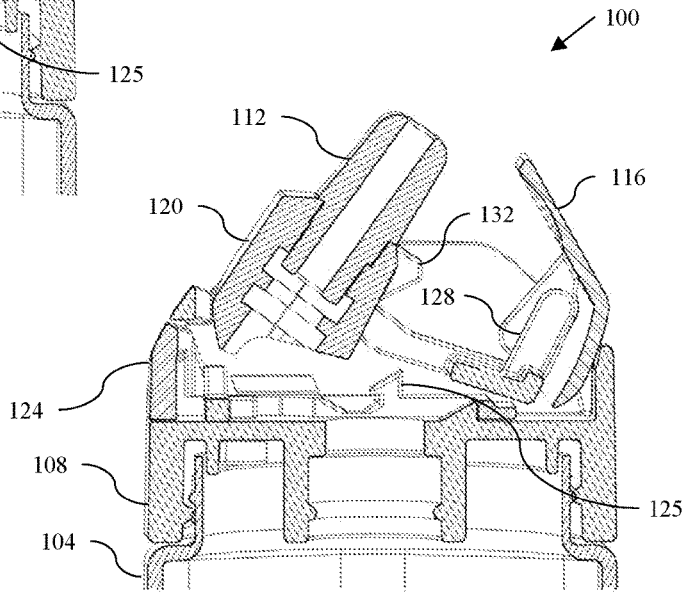
FIG. 7 is another cross-sectional view of the container of FIG. 1 illustrating a further movement of the spout collar toward an in-use position of the spout.
Figure 8:
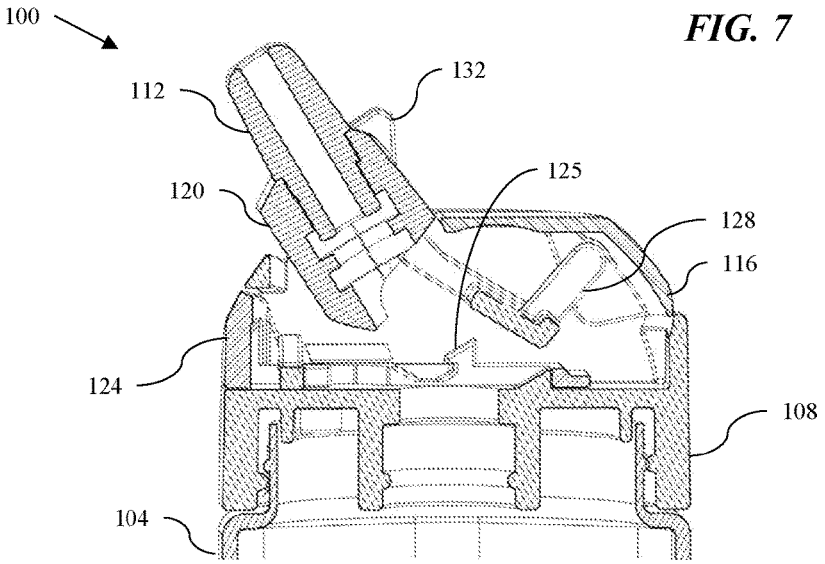
FIG. 8 is another cross-sectional view of the container of FIG. 1 illustrating the spout in an in-use position.
Figure 9:
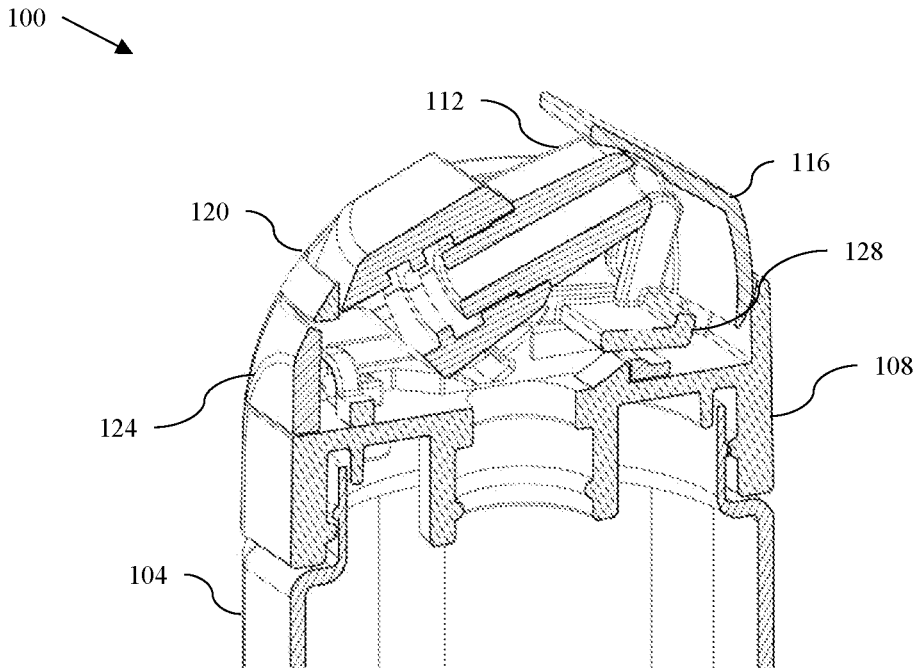
FIG. 9 is perspective, cross-sectional view of the container of FIG. 1 illustrating the spout and spout cover in an intermediate position between an in-use position and a stowed position.
Figure 10:
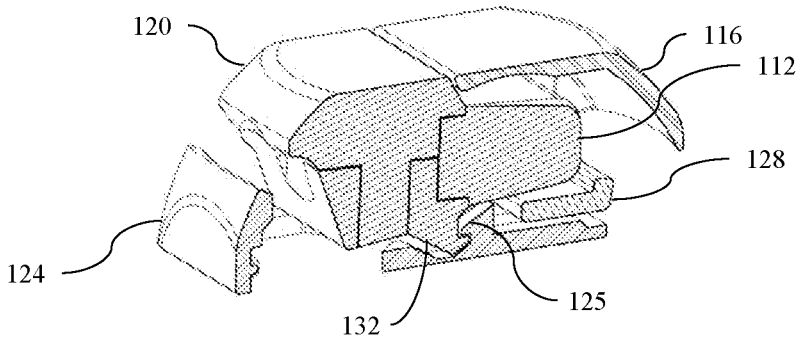
FIG. 10 is a perspective, cross-sectional view of the container of FIG. 1 illustrating one embodiments of an engagement between an actuator and the spout collar.
Figure 15:
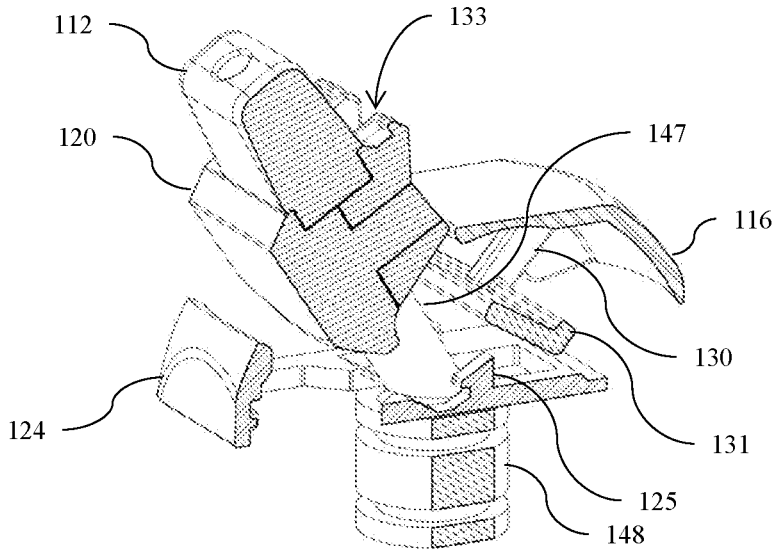
FIG. 15 is a perspective, cross-sectional view of the components of FIG. 11 illustrating the spout and spout cover in an in-use position.
Figure 16:
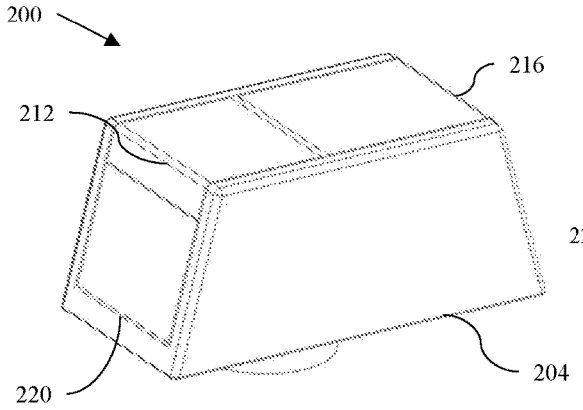
FIG. 16 is a perspective view of a lid according to certain embodiments of the invention. The lid is shown in a stowed position of a spout of the lid.
Figure 17:
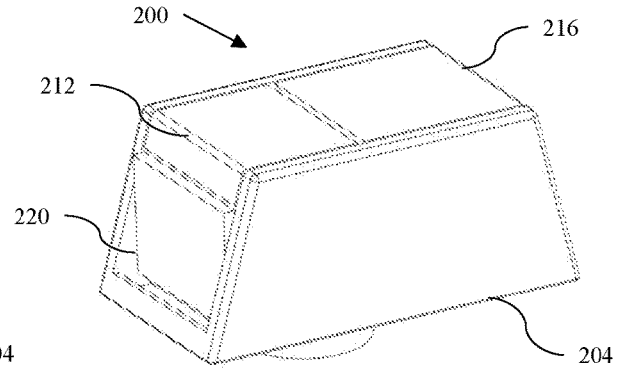
FIG. 17 is a perspective view of the lid of FIG. 16 illustrating a disengagement of an actuator from a spout collar of the lid.
Figure 18:
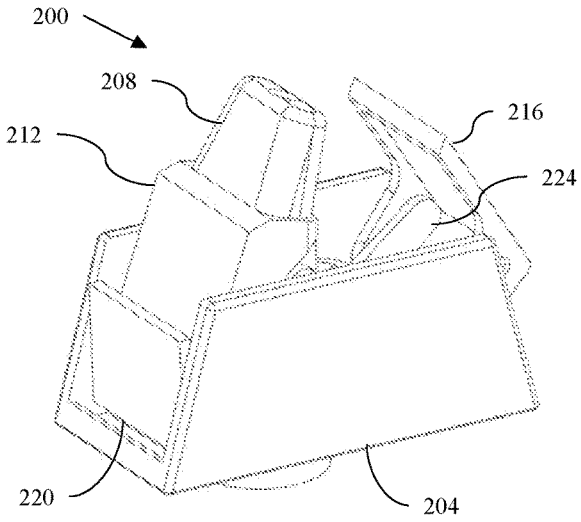
FIG. 18 is a perspective view of the lid of FIG. 16 illustrating a spout and a spout cover in a position intermediate between an in-use position and a stowed position.

Referencing FIG. 6 through FIG. 8 now, in one embodiment, after actuator hook 125 disengages collar catch 132, spout 112 begins to emerge from an inner space of lid 108. Through link 128, the movement of spout 112 causes spout cover 116 to begin rotation towards on open position (see FIG. 6). Further rotation of spout 112 towards an in-use position causes, via link 128, spout cover 116 to rotate away from spout 112 and towards a fully open position of spout cover 116 (see FIG. 7). Additional rotation of spout 112 to an in-use position causes spout cover 116, via link 128, to revert back to a closed position, and thereby, cover the inner space of lid 108 previously occupied by spout 112. FIG. 9 illustrates, among other things, spout 112 as spout 112 is rotated toward a stowed position. As depicted, as spout 112 is returned to the stowed position spout cover 116 rotates toward the center of container 100 to cover spout 112. FIG. 10 illustrates, among other things, in cross-section the engagement of actuator hook 125 with collar catch 132. Movement of spout 112 and/or spout collar 120 can be aided through methods well known in the relevant technology. For example, in one embodiment, straw 147 of suitable resilient material can be coupled to spout 112 and/or spout collar 120 (see FIG. 15). Deformation of straw 147 can provide a bias, for example, toward moving spout 112 and/or spout collar 120 toward the in-use position. Manual movement of spout collar 120 into the stowed position causes collar catch 132 to engage actuator hook 125 and, hence, keep spout collar 120 and spout 112 securely stowed within lid 108.

Figure 11:
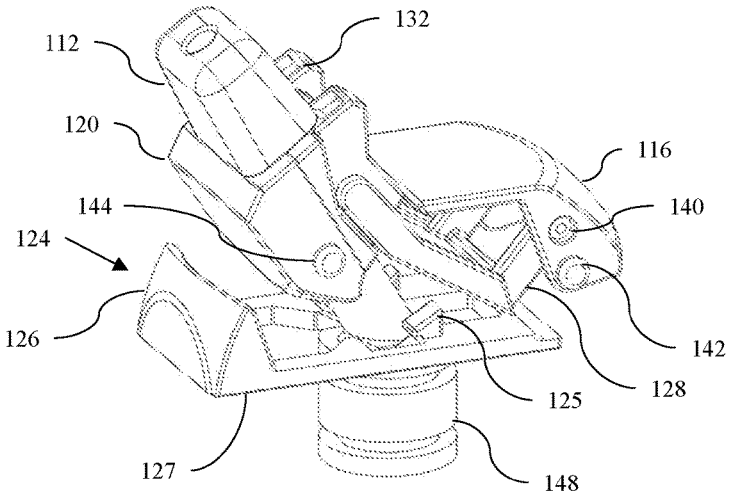
FIG. 11 is a perspective view of certain components of the container of FIG. 1 illustrating the spout in an in-use position.
Figure 12:
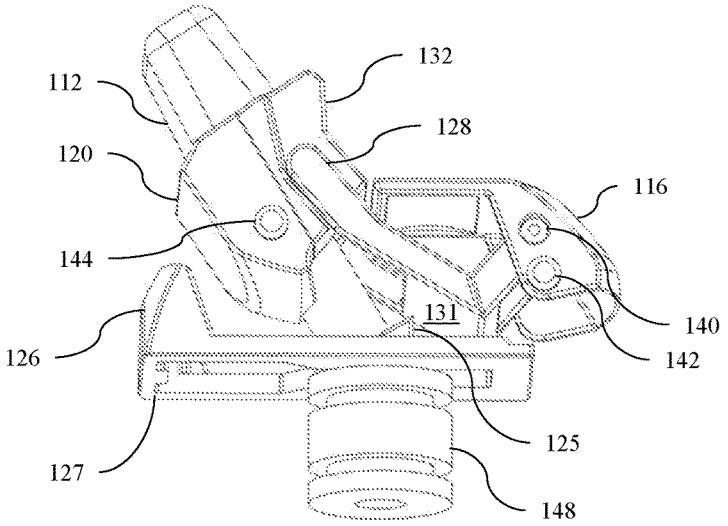
FIG. 12 is another perspective view of the components of FIG. 11.
Figure 12A:
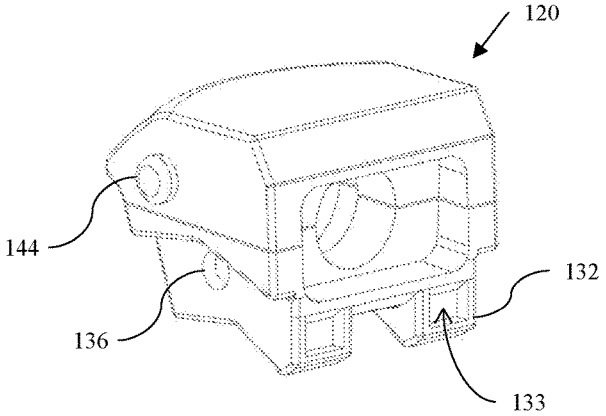
FIG. 12A is a perspective view of a spout collar according to one embodiment of the invention.

Referencing FIG. 11, FIG. 12, and FIG. 12A, in one embodiment actuator 124 can include actuator button 126 operatively coupled to actuator hook 125 via, for example, actuator base 127. When actuator button 126 is pressed radially inward, toward a center axis of seal 148, actuator hook 125 disengages collar catch 132 (see partial disengagement in FIG. 5). In certain embodiments, spout collar 120 can be provided with collar pivot 144, which is configured to facilitate a rotation of spout collar 120 (and, consequently, of spout 112) about collar pivot 144. Spout collar 120 can be provided with collar link attachment 136 for engaging with collar link pivot 129E (see FIG. 13A). In one embodiment, spout cover 116 can be provided with spout cover pivot 142 configured to facilitate a rotation of spout cover 116 about spout cover pivot 142. In some embodiments, link 128 is operatively coupled to spout cover 116 via link pivot 140. As illustrated in FIG. 11, in one embodiment, link 128 couples to spout collar 120 and to spout cover 116 at locations other than collar pivot 144 and spout cover pivot 142.

Figure 13:
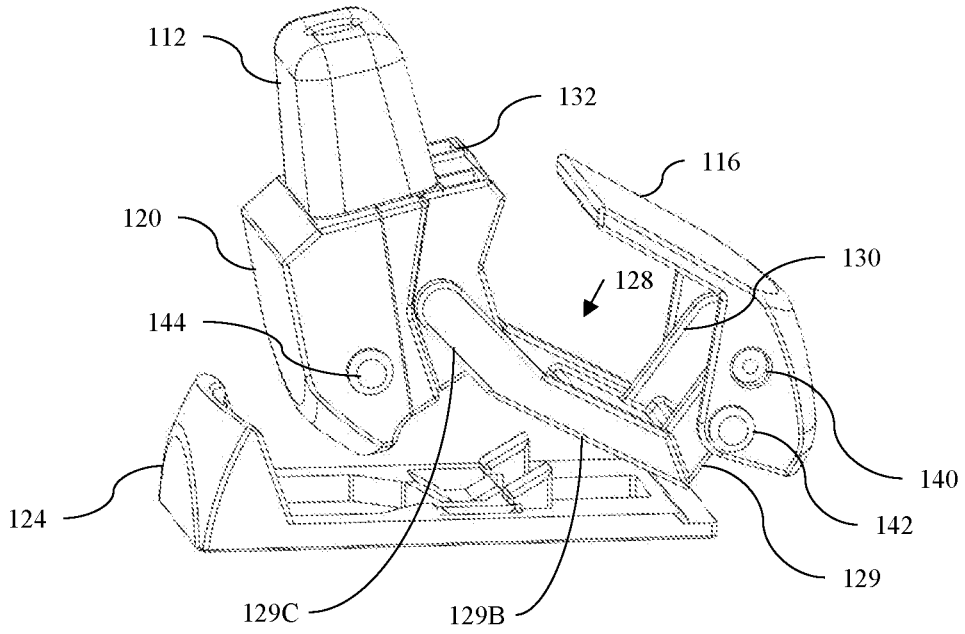
FIG. 13 is another perspective view of the components of FIG. 11 illustrating the spout and the spout cover in an intermediate position between an in-use position and a stowed position.
Figure 13A:
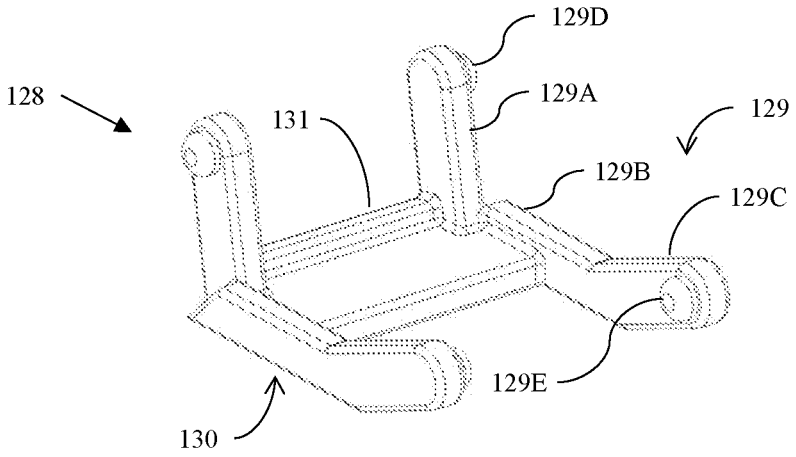
FIG. 13A is a perspective view of a link for use with a lid according to one embodiment of the invention.
Figure 14:
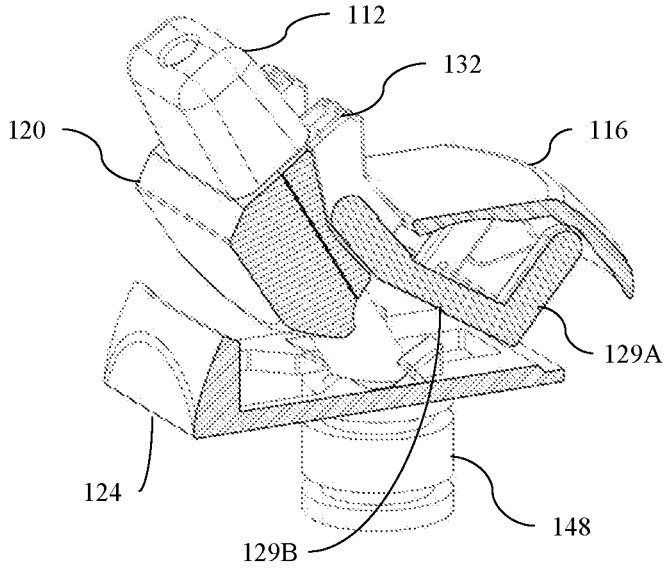
FIG. 14 is a perspective, cross-sectional view of the components of FIG. 11 illustrating one embodiment of a link operatively coupling the spout collar and the spout cover.

Referencing FIG. 13, FIG. 13A, and FIG. 14, in one embodiment link 128 can include first link arm 129 and second link arm 130, and first link arm 129 can be operatively coupled to second link arm 130 through link crosspiece 131 (see FIG. 12). In some embodiments first link arm 129 can include cover extension 129A coupled to link pivot 140 and to collar extension 129B. In some embodiments, cover extension 129A and collar extension 129B are one integral piece that has a generally 1-shape. In certain embodiments, collar extension 129B has extension distal end 129C that is a portion of collar extension 129B; extension distal end 129C, in some embodiments, bends at an angle relatively to a longitudinal axis of collar extension 129B. In some embodiments, cover extension 129A includes cover link pivot 129D for engaging with link pivot 140. Collar extension 129B can include collar link pivot 129E for engaging with collar link attachment 136. In certain embodiments, second link arm 130 is similarly shaped and configured as first link arm 129. Referencing FIG. 15, in one embodiment, collar catch 132 includes catch cavity 133 configured to engage with actuator hook 125.

Figure 19:
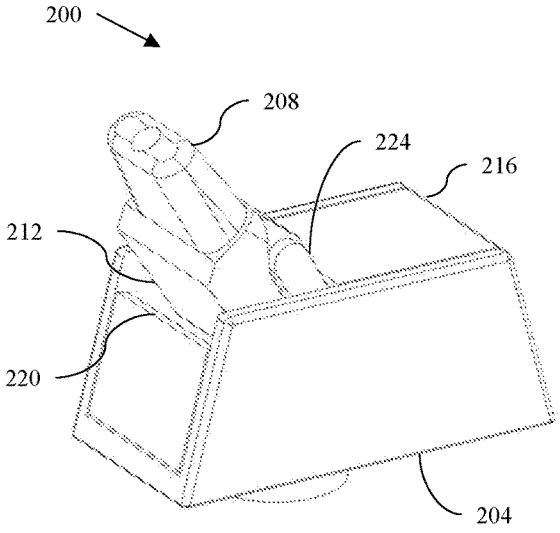
FIG. 19 is a perspective view of the lid of FIG. 16 illustrating the spout and the spout cover in an in-use position.

Referencing FIG. 16 through FIG. 23, another embodiment of the invention is now described. Lid 200 for a container can include lid body 204 that houses and supports spout 208, spout collar 212, spout cover 216, actuator 220, and link 224. Actuator 220 is configured to engage and disengage with spout collar 212 to allow spout collar 212 to rotate back and forth from a stowed position (FIG. 16) to an in-use position (FIG. 19). Spout collar 212 is operatively coupled to spout cover 216 via link 224. When actuator 220 disengages spout collar 212 (FIG. 17 and FIG. 18), spout collar 212 rotates toward the in-use position and, via link 224, causes spout cover 216 to rotate away from spout collar 212. Further rotation of spout collar 212 to the in-use position causes, via link 224, spout cover 216 to return to a closed position (FIG. 19). Lid 200, and any or all of its components, can be made of any suitable materials, such as plastics, aluminum, wood, rubber, and the like.

Figure 20:
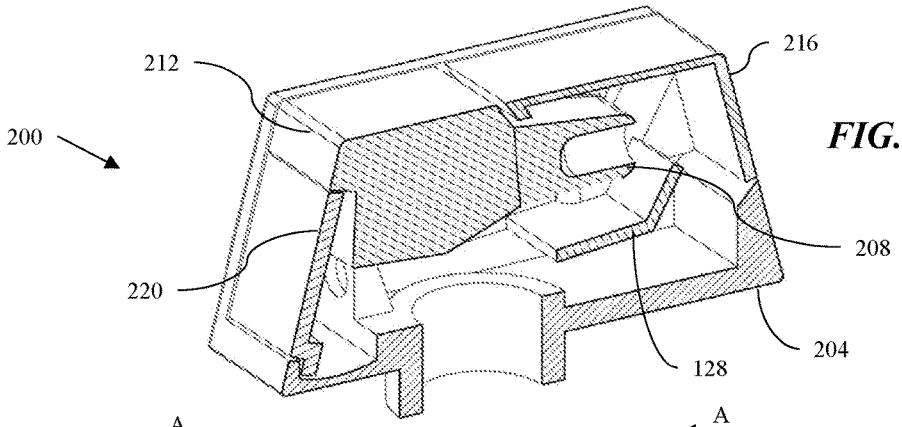
FIG. 20 is a perspective, cross-sectional view of the lid of FIG. 16 illustrating the spout and the spout cover in a stowed position.
Figure 21:
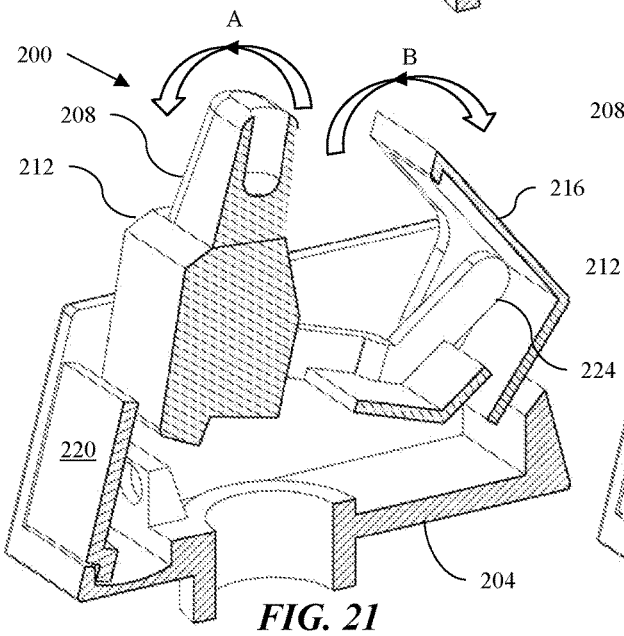
FIG. 21 is a perspective, cross-sectional view of the lid of FIG. 16 illustrating an initial rotation of the spout moving toward the in-use position and the spout cover moving away from the spout.
Figure 22:
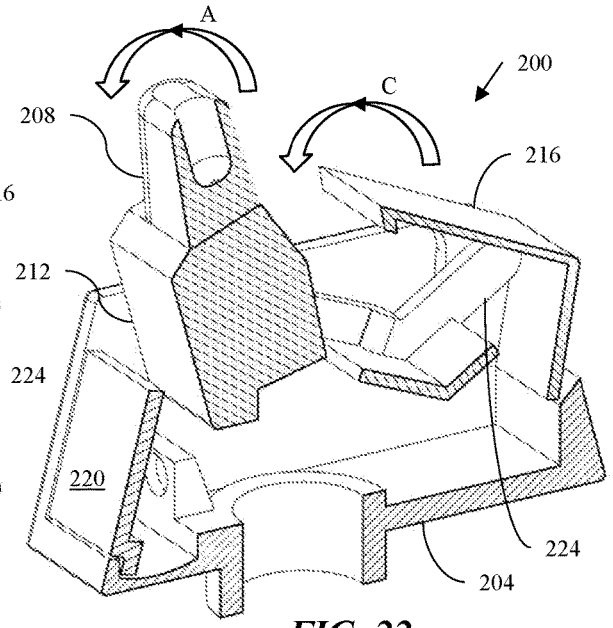
FIG. 22 is a perspective, cross-sectional view of the lid of FIG. 16 illustrating a further rotation of the spout cover toward an in-use position and the spout cover moving toward the spout.
Figure 23:
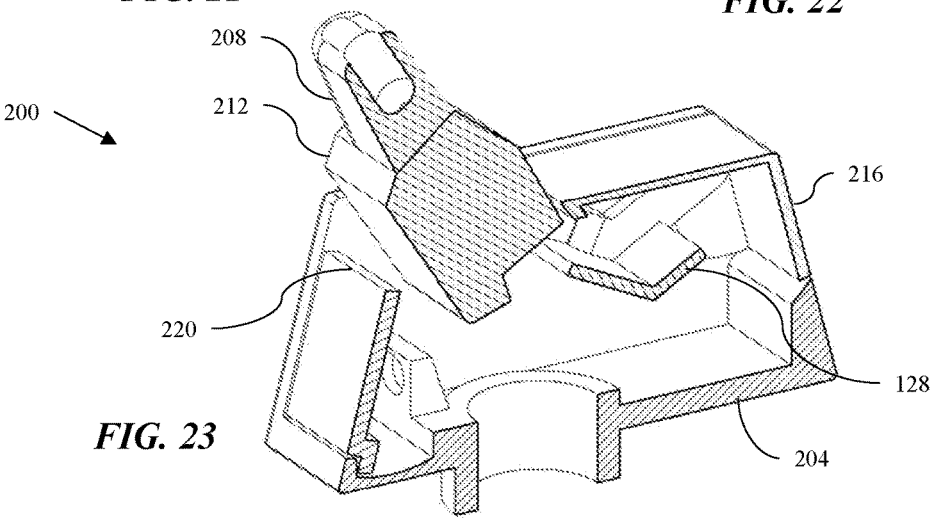
FIG. 23 is a perspective, cross-sectional view of the lid of FIG. 16 illustrating the spout in an in-use position and the spout cover in a closed position covering an inner space of the lid occupied by the spout when the spout is in the stowed position.

Referencing FIG. 20, in one embodiment, in a stowed position spout 208 and spout collar 212 occupy an inner space of lid body 204. In certain embodiments, spout collar 212 forms an exterior part of lid body 204. Spout cover 216 can also form part of lid body 204 and can be configured to cover spout 208 while spout 208 is in the stowed position. Referencing FIG. 21, when actuator 220 releases spout collar 212, spout collar 212 rotates about a suitable pivot (not shown) towards an in-use position along a rotation A. The initial rotation of spout collar 212 causes, via link 224, spout cover 216 to rotate away from spout 208 along a rotation B. Referencing FIG. 22, as spout collar 212 continues to rotate along rotation A, spout collar 212 causes, via link 224, spout cover 216 to rotate back towards spout 208 along a rotation C. Once spout 208 is in an in-use position, spout cover 216 comes to a closed position, in which closed position spout cover 216 covers the space previously occupied by spout 208. This configuration advantageously prevents dirt (for example) from entering the space that would otherwise be left uncovered if spout cover 216 were not returned to the closed position—and to remain in the closed position while spout 208 is an in-use position (see FIG. 23).

Figure 24:
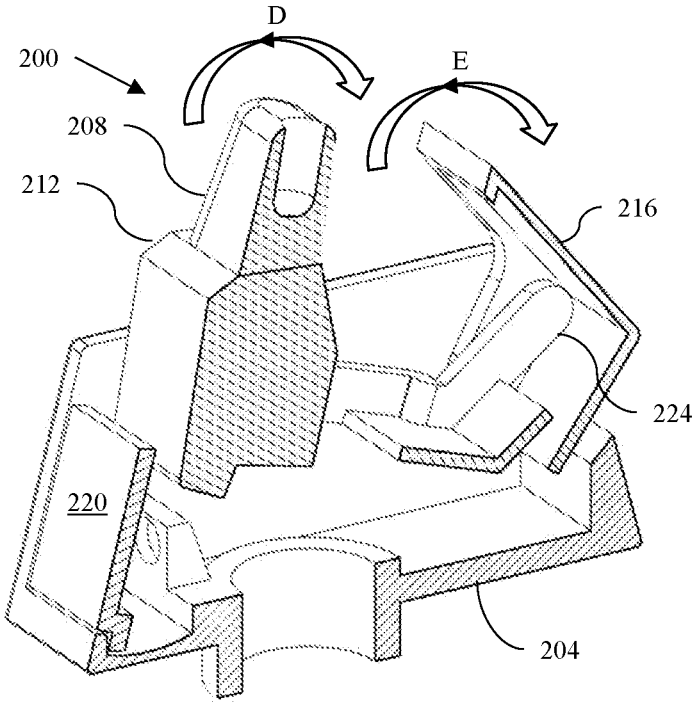
FIG. 24 is a perspective, cross-sectional view of the lid of FIG. 16 illustrating the spout moving toward the stowed position and the spout cover moving away from the spout.
Figure 25:
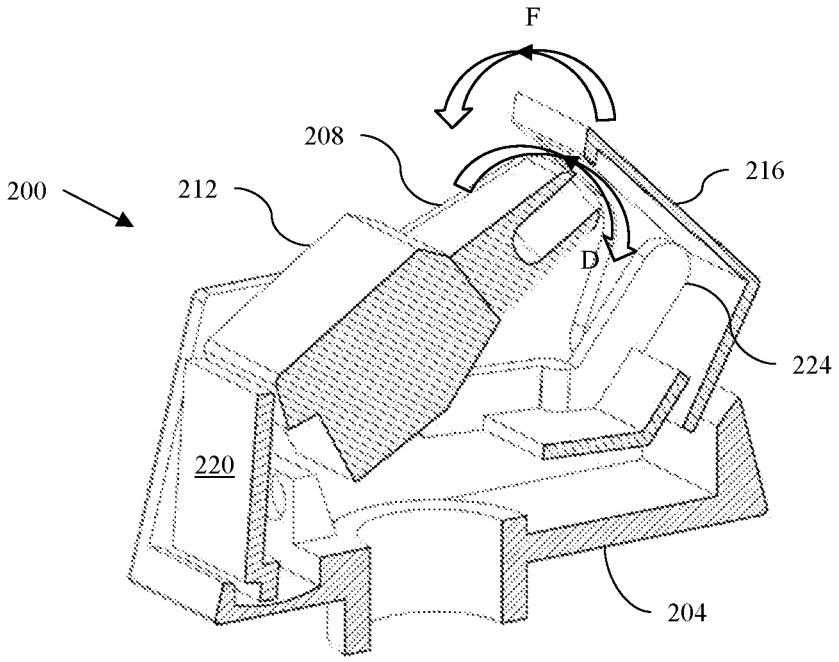
FIG. 25 is a perspective, cross-section view of the lid of FIG. 16 illustrating the spout further moving toward the stowed position and the spout cover moving toward the spout to cover the spout.

Referencing FIG. 24, as spout 208 is rotated in along a direction D, spout 208 causes spout cover 216 to open by rotating in a direction E. This opens the space to allow spout 208 to move in a direction for being placed in the stowed position. Referencing FIG. 25, as spout 208 continues to rotate along a rotation D, spout cover 216 reverses rotation and rotates in a direction F towards a closed position, then finishing at the stowed position (see FIG. 20).

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible in light of the above teachings without departing from the following claims.

The invention claimed is:

1. A method of manufacturing a lid for a container, the method comprising:
- providing a spout;
- providing a spout collar and coupling the spout collar to the spout;
- providing a link and coupling the link to the spout collar;
- providing a spout cover and coupling the spout cover to the link;
- configuring the spout collar and the link to:
  - rotate the spout cover away from the spout as the spout initially rotates from an inner space of the lid in a stowed position of the spout towards an in-use position of the spout;
  - rotate the spout cover back towards the spout as the spout continues a rotation toward the in-use position;
  - close the spout cover over said inner space as the spout reaches the in-use position;
  - rotate the spout cover away from the spout as the spout initially rotates from the in-use position toward the stowed position;
  - rotate the spout cover back towards the spout as the spout continues a rotation toward the stowed position; and
  - close the spout cover over the spout as the spout reaches the stowed position.

2. The method of claim 1, further comprising providing an actuator and coupling the actuator to the spout collar.

3. The method of claim 1, further comprising:
- providing a collar pivot and coupling the collar pivot to the spout collar, the collar pivot configured to provide a rotation support for the spout collar;
- providing a spout cover pivot coupling the spout cover pivot to the spout cover, the spout cover pivot configured to provide a rotation support for the spout cover; and
- coupling the link, respectively, to the spout collar and to the spout cover at locations other than the collar pivot and the spout cover pivot.

4. The method of claim 1, wherein providing a link comprises:
- providing a first link arm;
- providing a second link arm; and
- providing a crosspiece and coupling the crosspiece to the first link arm to the second link arm.

5. The method of claim 4, wherein providing a first link arm comprises:
- providing a cover extension;
- providing a collar extension;
- coupling the spout cover to the collar extension; and
- coupling the collar extension to the spout collar.

6. The method of claim 5, wherein providing a collar extension further comprises providing an extension distal end, and wherein the extension distal end bends at an angle relative to a longitudinal axis of the collar extension.

7. A lid for a container, the lid comprising:
- a spout collar;
- a spout coupled to the spout collar;
- a link coupled to the spout collar;
- a spout cover coupled to the link;
- wherein from a stowed position of the spout, an initial rotation of the spout collar in a first direction causes, via the link, the spout cover to rotate in a second direction, said first direction being towards an in-use position of the spout, said second direction being counter to the first direction;

wherein a further rotation of the spout collar in the first direction causes, via the link, the spout cover to rotate in a third direction, said third direction being rotationally in the same direction as the first direction;

wherein from the in-use position of the spout, an initial rotation of the spout collar in a fourth direction causes, via the link, the spout cover to rotate in a fifth direction, said fourth direction being towards an stowed position of the spout, said fifth direction being rotationally in the same direction as the fourth direction;

wherein a further rotation of the spout collar in the fourth direction causes, via the link, the spout cover to rotate in a sixth direction, said sixth direction being counter to the fifth direction;

wherein, in the in-use position of the spout, the spout cover is in a closed position and covers a space that is occupied by the spout when the spout is in the stowed position; and wherein, in the stowed position of the spout, the spout cover is in a closed position covering the spout.

8. The lid of claim 7, further comprising an actuator coupled to the spout collar.

9. The lid of claim 7, further comprising:

a collar pivot operatively coupled to the spout collar, the collar pivot configured to provide a rotation support for the spout collar;

a spout cover pivot operatively coupled to the spout cover, the spout cover pivot configured to provide a rotation support for the spout cover; and wherein the link attaches, respectively, to the spout collar and to the spout cover at locations other than the collar pivot and the spout cover pivot.

10. The lid of claim 7, wherein the link comprises:

a first link arm;

a second link arm; and a crosspiece coupling the first link arm to the second link arm.

11. The lid of claim 10, wherein at least one of the first link arm and the second link arm comprises:

a cover extension;

a collar extension;

wherein the cover extension is coupled to the spout cover and to the collar extension; and wherein the collar extension is coupled to the spout collar.

12. The lid of claim 11, wherein the collar extension comprises an extension distal end, and wherein the extension distal end bends at an angle relative to a longitudinal axis of the collar extension.

13. A lid for a container, the lid comprising:

a spout;

a spout cover;

a link operatively coupling the spout and the spout cover;

wherein as the spout begins to emerge from an inner space of the lid, the movement of the spout causes, via the link, the spout cover to begin a rotation towards on open position;

wherein further rotation of the spout towards an in-use position causes, via the link, the spout cover to rotate away from the spout and towards a fully open position of the spout cover;

wherein additional rotation of the spout to the in-use position causes, via the link, the spout cover to revert back to a closed position, and thereby, cover an inner space of the lid previously occupied by the spout;

wherein as the spout begins to rotate toward a stowed position from the in-use position, the movement of the spout causes, via the link, the spout cover to open and rotate away from the spout; and wherein as the spout is rotated into the stowed position the spout cover rotates back towards the spout to cover the spout.

14. The lid of claim 13, further comprising a spout collar coupled to the spout and to the link, wherein the spout is operatively coupled to the spout cover through the spout collar and the link.

15. The lid of claim 14, wherein the spout and the spout collar are one integral piece.

16. The lid of claim 14, further comprising an actuator coupled to the spout collar.

17. The lid of claim 13, wherein the link comprises:

a first link arm;

a second link arm; and a crosspiece coupling the first link arm to the second link arm.

18. The lid of claim 17, wherein at least one of the first link arm and the second link arm comprises:

a cover extension;

a collar extension;

wherein the cover extension is coupled to the spout cover and to the collar extension; and wherein the collar extension is coupled to the spout collar.

19. The lid of claim 18, wherein the collar extension comprises an extension distal end, and wherein the extension distal end bends at an angle relative to a longitudinal axis of the collar extension.

20. The lid of claim 14, further comprising:

a collar pivot operatively coupled to the spout collar, the collar pivot configured to provide a rotation support for the spout collar; and a spout cover pivot operatively coupled to the spout cover, the spout cover pivot configured to provide a rotation support for the spout cover.

* * * * *